US005272606A

United States Patent [19]

Blaney

[11] Patent Number: 5,272,606

[45] Date of Patent: Dec. 21, 1993

[54] DUAL CIRCUIT LANTERN

[76] Inventor: Mark A. Blaney, 471 Upper Wentworth, Hamilton, Ontario, Canada, L9A-4T6

[21] Appl. No.: 85,110

[22] Filed: Jul. 2, 1993

[51] Int. Cl.[5] ..... F21L 7/00

[52] U.S. Cl. ..... 362/157; 362/20; 362/205; 362/208; 362/211

[58] Field of Search ..... 362/157, 204, 205, 208, 362/20, 211, 212

[56] References Cited

U.S. PATENT DOCUMENTS

| | | | |
|---|---|---|---|
| 3,299,262 | 1/1967 | Duncan | 362/157 |
| 4,803,605 | 2/1989 | Schaller et al. | 362/184 |
| 5,214,353 | 5/1993 | Nilssen | 362/157 |

*Primary Examiner*—Richard R. Cole

*Attorney, Agent, or Firm*—Matthew P. Lynch

[57] ABSTRACT

This invention relates to a portable, hand holdable lantern (flashlight or lamp) which has a reserve power supply. The reserve power supply is in the form of a second identical circuit which after expending the life of the first set of batteries, the second set of batteries can be activated continuing the illumination of the lantern.

3 Claims, 2 Drawing Sheets

DUAL CIRCUIT LANTERN

BACKGROUND OF THE INVENTION

1. Field of the Invention

The field of this invention relates to flashlights and other hand holdable type of illumination apparatuses.

2. Description of the Prior Art

The concept of this invention is being discussed in relation to a lantern. However, it is considered to be within the scope of this invention that the term lantern is to include a flashlight, a lamp or any other type of hand holdable by a human being, illumination device.

Lanterns are in exceedingly common use. The typical construction for a lantern would be a housing within which is incorporated a battery source and a light bulb. A manually operated switch is included within the circuit between the battery and the light bulb. Turning on the switch causes the light bulb to be illuminated. Turning off of the switch causes the light bulb to not be illuminated.

Within certain environments, it is desirable to make sure that the lantern will always operate. One of these environments would be underwater, in other words during scuba diving. The user of the lantern can be in a close-quartered underwater environment and if the lantern goes out, that can place the individual in extreme danger. Therefore, in certain instances, there is a need to incorporate a reserve power arrangement in conjunction with the lantern.

Within the prior art there are numerous multi-battery powered flashlights. However, all such flashlights are known to have a single usable power source that provide for replacement or for recharging when necessary upon battery failure.

SUMMARY OF THE INVENTION

The primary objective of the present invention is to construct a lantern where fifty percent of the maximum battery capacity power is maintained and reserved by way of a separate circuit and switch.

Another objective of the present invention is to construct a lantern which by providing reserved power constitutes a safety item for individuals using the lantern in dangerous environments when they are not able to replace batteries due to battery failure.

Another objective of the present invention is to construct a lantern with two separate circuits where the lantern can be manufactured at a reasonable cost and therefore sold to the ultimate consumer at a reasonable cost.

The lantern of the present invention includes a housing within which is incorporated a first battery set and a second battery set located in a stacked relationship. Associated with the battery sets is a dual filament light bulb. The first battery set illuminates one filament of the bulb where the second battery set illuminates the second filament of the bulb. An appropriate on-off switch is incorporated with the flashlight. Also, there is incorporated a second switch which is to select which of the two circuits is to be used.

DETAILED DESCRIPTION OF THE SHOWN EMBODIMENT

Figure 1:
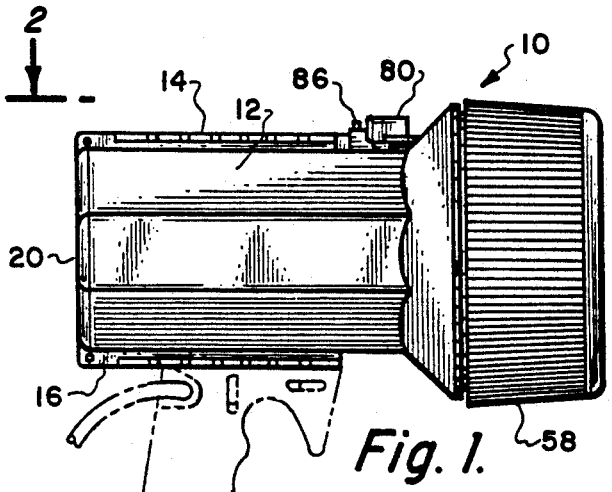
FIG. 1 is a side, elevational view of a lantern in which has been constructed in accordance with this invention.

Referring particularly to the drawings there is shown the lantern 10 constructed in accordance with this invention which includes an integral plastic lantern housing 12. Mounted on the exterior of the housing 12 are handle attachment rails 14 and 16. These rails 14 and 16 are to be connected to a handle 17. The handle 17 can be fastened at any longitudinal length on either of the rails 14 and 16. The connection between the handle 17 and the rails 14 and 16 is deemed to be known prior to this invention and is not deemed to be part of this invention.

The housing 12 includes an enlarged internal compartment 18. Mounted within the internal compartment 18 adjacent the bottom 20 of the housing is a lower coil spring assembly 22. Resting on the coil springs 22 are four in number of batteries 24. Each battery 24 has a battery 26 stacked thereon in an in-line position. Therefore, there are four in number of the batteries 26. The batteries 26 connect to an upper coil spring assembly 28. In between the aligned series of batteries 24 and 26 there are used various reselient insulating spacers 30. Surrounding the springs 28 is an insulative pad 32.

Electrical current from the batteries 24 and 26 are to be supplied through the springs 28 to electrical contacts 34, 36, 38 and 40. These electrical contacts 34, 36, 38 and 40 are fixedly mounted within the bottom surface 42 of a cup 44. Centrally mounted within the cup 44 is a light bulb 46. The light bulb 46 is replacably mounted relative to a light bulb mount 48 which is integral with the cup 34. Surrounding the mount 48 is a coil spring 50. The coil spring 50 exerts a continuous bias between upstanding protrusion 52 of the bottom 42 and reflector 54. The light bulb 42 extends through a hole 56 formed within the reflector 54. The reflector 54 is mounted within a shroud 58. The shroud 58 is threadably secured by threads 60 to the outer end 62 of the housing 12. The shroud 60 includes a lens 64 through which light from the light bulb 46 is to pass.

Mounted on the bottom 42 of the cup 44 is pellet 66. Pellet 66 is mounted within a coil spring 68 and is located between protrusions 70 and 72 which are integral with and extend upward from the bottom 42. The pellet 66 will be constructed of a substrate in conjunction with one or more precious metals which function as catalysts. Typical material of the substrate would be alumina oxide. The purpose of the pellet 66 is to absorb any hydrogen that is produced from the batteries 24 and 26. Covering the substrate will be a protective film (not shown) which is to function to keep the reaction of the hydrogen with the pellet 66 to proceed at a slow pace rather than a rapid pace.

Electrically connected to the light bulb 46 is an internal switch 74. Switch 74 is mounted on the cup 44. The switch 74 is a three position switch and can be located in either position A, position B or position C. Position C is located between positions A and B. Switch 74 is movable by means of an actuator 76 which is fixedly mounted by means of a bolt 78 to a lever 80. The lever 80 is located on the exterior surface of the housing 12. The lever 80 includes a recess 82. An awl 84 is to be connectable with the recess 82. The awl 84 is mounted on a slide 86. Slide 86 is slidingly mounted on small rail 88 which is integrally formed on the housing 12.

With the awl 84 connecting with recess 82, the lever 80 is symetrically mounted on the housing 12 and the slot 90 of the actuating lever 76 locates button 92 in a central position, that being position C. As a result, no electrical energy is being supplied to the bulb 46 and neither filament 94 or 96 of the bulb 46 is illuminated.

Figure 6:
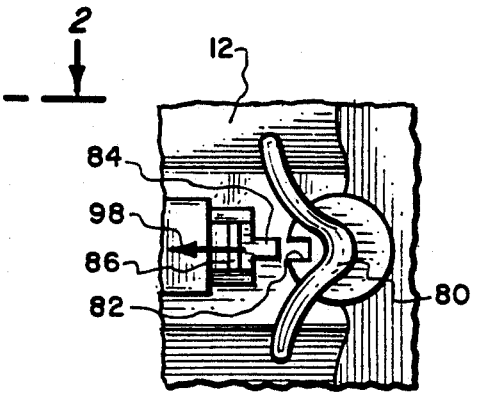
FIG. 6 is a view clearly showing the on-off switch and circuit selection switch incorporated within the lantern of the present invention.
Figure 2:
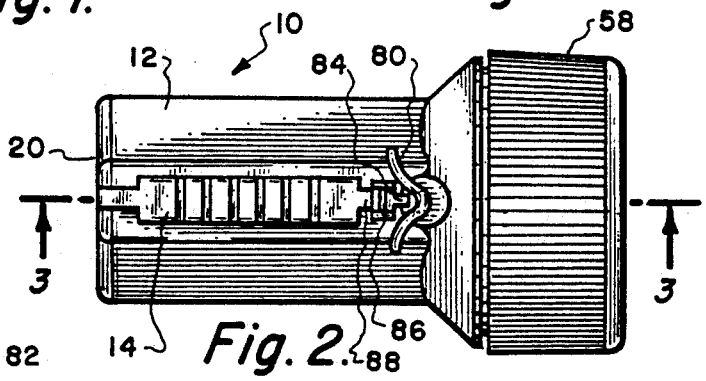
FIG. 2 is a top, plan view of the lantern of FIG. 1 taken along line 2—2 of FIG. 1.
Figure 7:
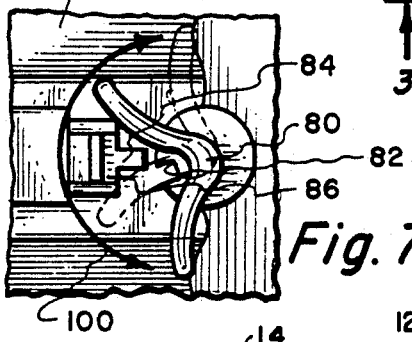
FIG. 7 is a view similar to FIG. 6 but showing the different positions of the circuit selection switch.
Figure 3:
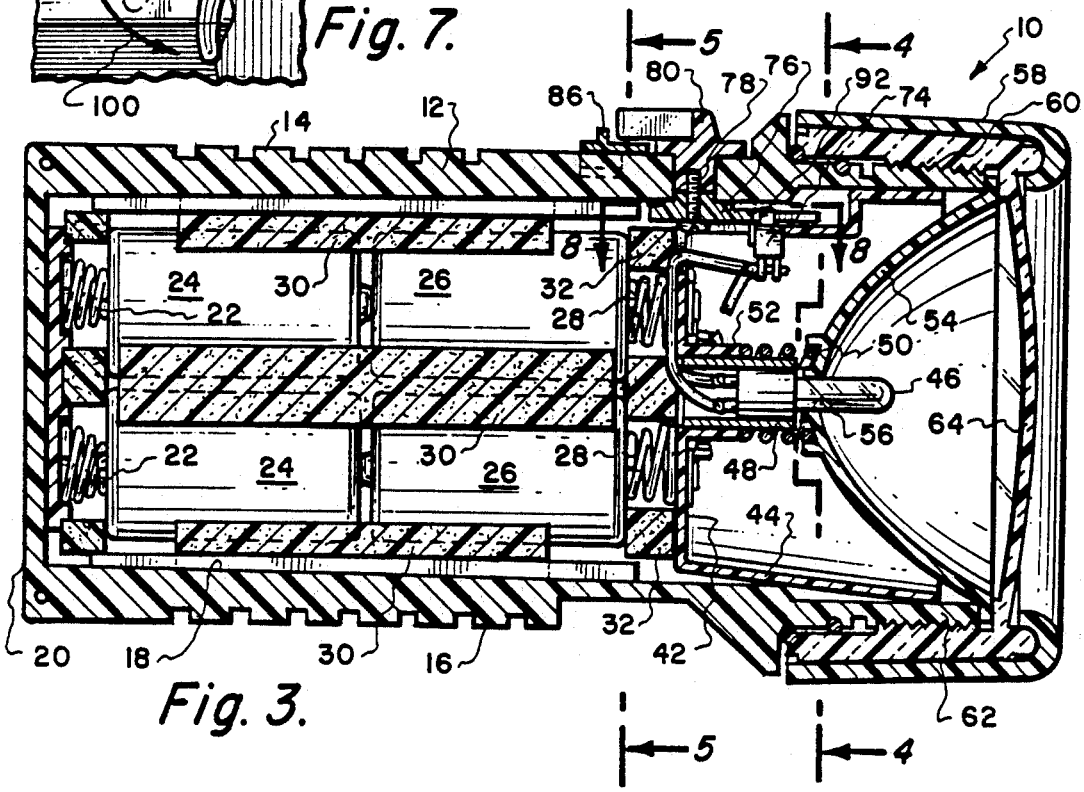
FIG. 3 is a longitudinal, cross-sectional view through the lantern constructed in accordance with this invention taken along line 3—3 of FIG. 2.
Figure 4:
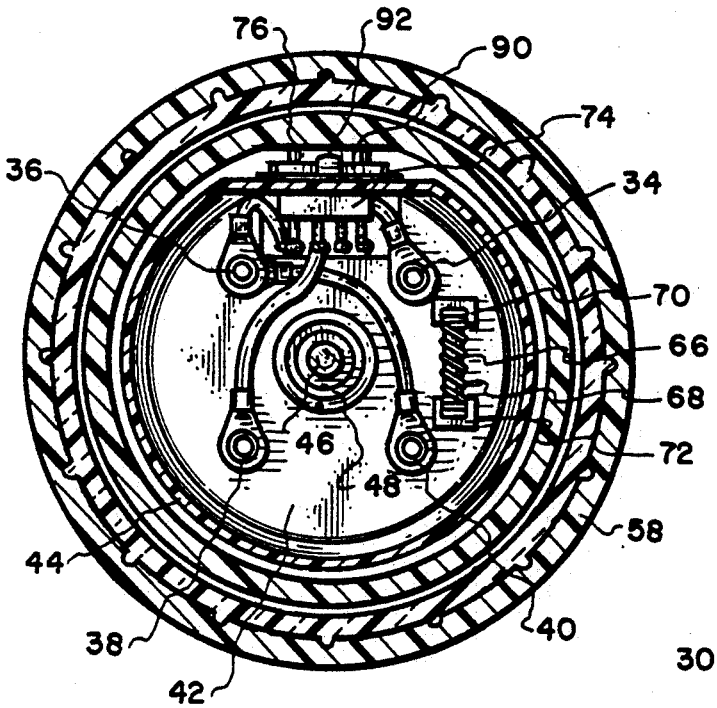
FIG. 4 is a transverse, cross-sectional view through the light bulb portion of the lantern of the present invention taken along line 4—4 of FIG. 3.
Figure 8:
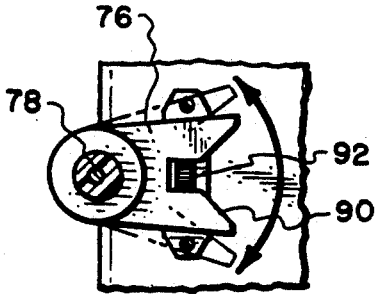
FIG. 8 shows a view of the actuator which is operated by the circuit selection switch within the confines of the lantern.
Figure 5:
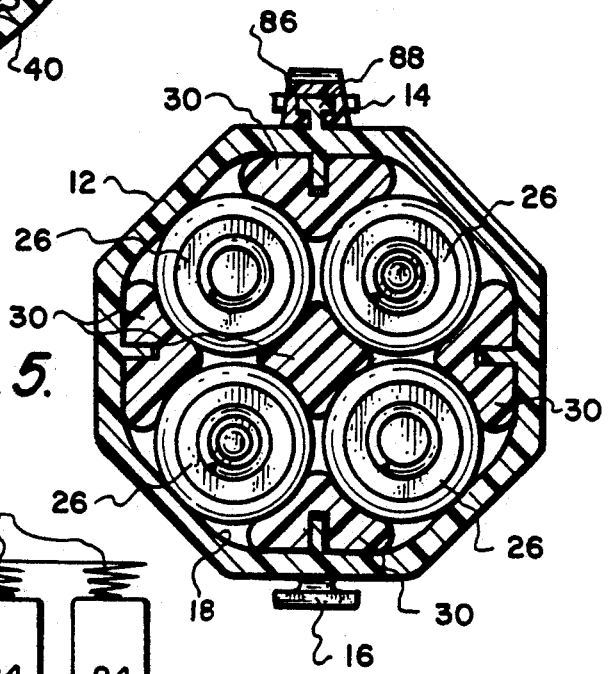
FIG. 5 is a transverse, cross-sectional view showing in more detail the battery arrangement incorporated within the lantern of the present invention, taken along line 5—5 of FIG. 3.
Figure 9:
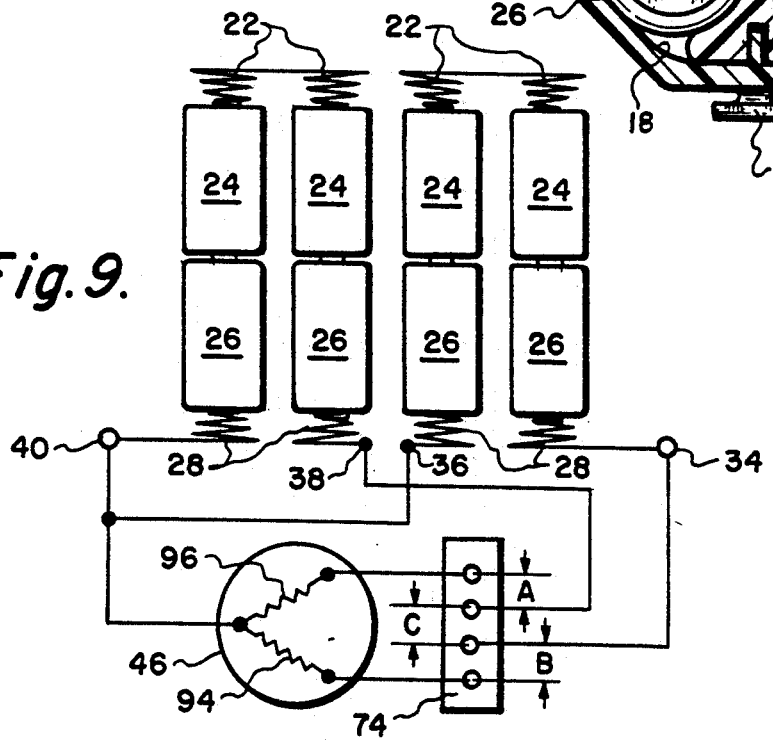
FIG. 9 is an electrical schematic of the lantern of the present invention.

Now it is desirable to illuminate the lantern 10. The user pulls rearwardly on the slide 86 disengaging the awl 84 from the recess 82. This position is clearly shown in FIG. 6 of the drawings with the rearward movement of the slide 86 being depicted by arrow 98. Let now the user move the lever 80 as represented by arrow 100 in FIG. 7 to the solid line position shown in FIG. 7. This will cause the button 92 to be moved to position B. In position B, filament 94 will be activated by four in number out of the eight total of the batteries 24 and 26.

Now let it be assumed that the life of the batteries that have been illuminating filament 94 has been expended. The user only need move lever 80 in the opposite direction, again, as represented by arrow 100 which will move the actuator 76 in the opposite direction moving button 92 to position A. In position A, filament 96 will be illuminated by the remaining four batteries 24 and 26. Therefore, the lantern still continues to be usable.

When the user is able to get to an environment where the expired batteries can be replaced, the user is to proceed with that replacement.

What is claimed is:

1. A dual circuit lantern comprising:

a housing having an internal compartment, a battery arrangement mounted within said internal compartment, said battery arrangement being divided into a first battery set and a second battery set;

lamp means mounted within said internal compartment, said lamp means being illuminatable by said battery arrangement;

an on-off switch mounted on said housing, said on-off switch for causing illumination and for causing de-illumination of said lamp means; and a circuit selection switch mounted on said housing, said circuit selection switch being movable to select either said first battery set or said second battery set, whereby upon the life ending of said first battery set said circuit selection switch is to be moved to activate said second battery set (and vice versa) to re-illuminate said lamp means.

2. The dual circuit lantern as defined in claim 1 wherein:

said lamp means comprising a double filament lamp bulb.

3. The dual circuit lantern as defined in claim 2 wherein:

said second battery set being located in a stacked relationship relative to said first battery set.

* * * * *